United States Patent [19]

Zucker

[11] 4,089,475

[45] May 16, 1978

[54] MIXING AND COMMINUTING MACHINE FOR TREATING LIQUID-SOLID MIXTURES

[75] Inventor: Friedrich J. Zucker, Neuss, Germany

[73] Assignee: Supraton F. J. Zucker KG, Neuss, Germany

[21] Appl. No.: 759,605

[22] Filed: Jan. 14, 1977

[30] Foreign Application Priority Data

Jan. 15, 1976 Germany ..... 2601335

[51] Int. Cl.[2] ..... B02C 23/36

[52] U.S. Cl. ..... 241/46.06; 241/244; 241/261.1

[58] Field of Search ..... 241/46 R, 46.02, 46.06, 241/244, 261.1

[56] References Cited

U.S. PATENT DOCUMENTS

| | | | |
|---|---|---|---|
| 3,195,867 | 7/1965 | Mould | 241/244 |
| 3,224,689 | 12/1965 | Behrens et al. | 241/244 |
| 3,960,332 | 6/1976 | Seifert | 241/46.06 |
| 3,976,252 | 8/1976 | PerDue | 241/46.02 |

*Primary Examiner*—Granville Y. Custer, Jr.
*Attorney, Agent, or Firm*—John C. Smith, Jr.

[57] ABSTRACT

A mixing and comminuting machine for the treatment of liquid-solid media and the like by compression and decompression under centrifugal action comprises an assembly including stator and rotor members which may be readily replaced as a single unit in the machine. The machine casing contains the assembly which includes a casing inset which is releasably retained in the casing and to which the stator member is stationarily secured. A wall spaced from the stator member is also secured to the casing inset for retaining the rotor member in position between the wall and the stator member such that the rotor member may freely rotate at the position when secured to rotating drive means.

19 Claims, 2 Drawing Figures

MIXING AND COMMINUTING MACHINE FOR TREATING LIQUID-SOLID MIXTURES

BACKGROUND OF THE INVENTION

This invention relates to a mixing and comminuting machine for treating liquid-solid mixtures by compressing and decompressing the mixtures under centrifugal action between the confronting working surfaces of rotor and stator members.

Mixing and comminuting machines are used to blend, mix and homogenize media of different types. For example, in processing tar, fumes and tar-like products are produced which contain as a dispersion or suspension slag, ashes, unburned carbon, etc. which are passed through a mixing and comminuting machine to finely comminute the solids. In power plants consuming coal, it is desirable that the volatile tar components, flue dust, etc. be in finely distributed form in the combustion gases as the gases are passed through filters. It is common to pass the combustion products through a mixing and comminuting machine to obtain the fine distribution of solids in the combustion product gases. A major problem with mixing and comminuting machines of this type is that the solid materials to be comminuted erode the internal elements of the machine. The confronting working surfaces of the rotor and stator members become worn and also the supply channels in the casing of the mixing and comminuting machine are subject to erosion. Furthermore, the solid materials such as tar and flue dust tend to settle over a period of time in the mixing and comminuting machine so that the flow of the liquid-solid media through the machine is impaired. As a result of the erosion, particularly on the working surfaces of the stator and rotor members the output of the mixing and comminuting machine is decreased substantially over an extended period of time. The mixing or homogenizing efficiency is reduced with concurrent progressively larger particles of, for example, tar and flue dust being emitted from the machine and a resultant reduction in the efficiency of the filter.

Similarly, when the mixing and comminuting machines are used for the treatment of carbon or the products of the gasification of coal, the erosive action of the media progressively reduces the efficiency of the machine and consequently its economic operation.

It is an object of the present invention to provide a mixing and comminuting machine in which the stator and rotor members may be readily replaced as a single unit or assembly when they become worn. Thus, the single unit or assembly including rotor and stator members is interchangeable in the machine reducing the amount of time required to replace the rotor and stator members.

Another object of the invention is to provide a single unit or assembly including the rotor and stator members, each having confronting working surfaces thereon, in which the rotor and stator members are disposed in a predetermined spaced relationship in the assembly. Thus, when replacing the assembly, time is not required to adjust the distance between the confronting working surfaces of the stator and rotor members.

A further object of the invention is to provide a mixing and comminuting machine wherein the cover for the chamber containing the assembly includes a spacer bushing which serves to automatically retain the assembly in position in the chamber when the cover is properly positioned. Thus, upon removing the cover the assembly is automatically released and can be readily replaced in the chamber.

A still further object of the invention is to provide a mixing and comminuting machine wherein the casing defining the chamber containing the assembly can itself also be readily replaced with the assembly in the event that the casing becomes excessively worn.

These and other objects of the invention will become apparent in the following description.

BRIEF DESCRIPTION OF THE DRAWINGS

In the following description and appended claims, reference is made to the accompanying drawings forming a part of the specification wherein like reference characters designate corresponding parts in the several views.

DESCRIPTION OF A SPECIFIC EMBODIMENT

Figure 1:
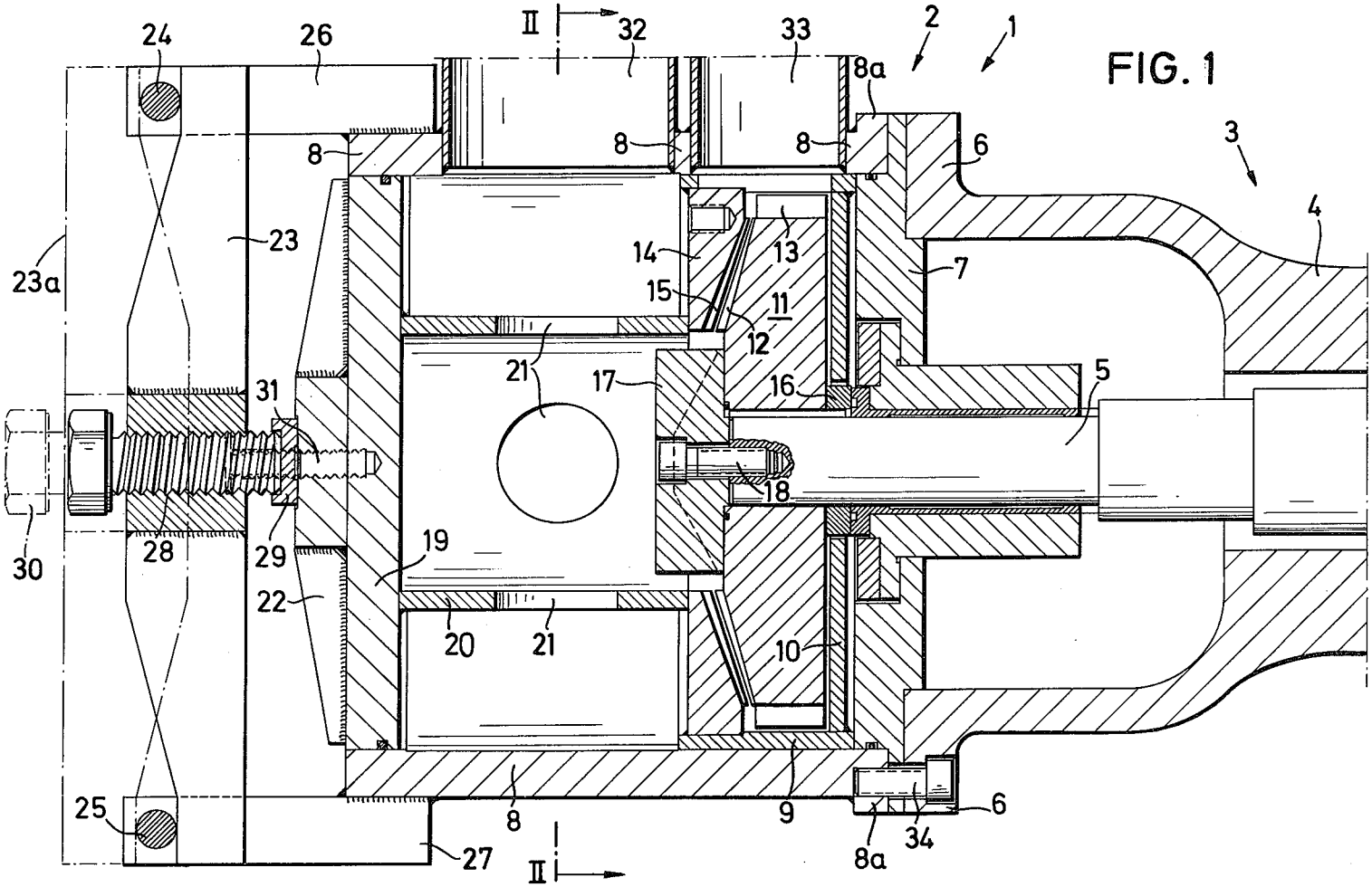
FIG. 1 is a cross-sectional view of one embodiment of the mixing and comminuting machine of the invention.
Figure 2:
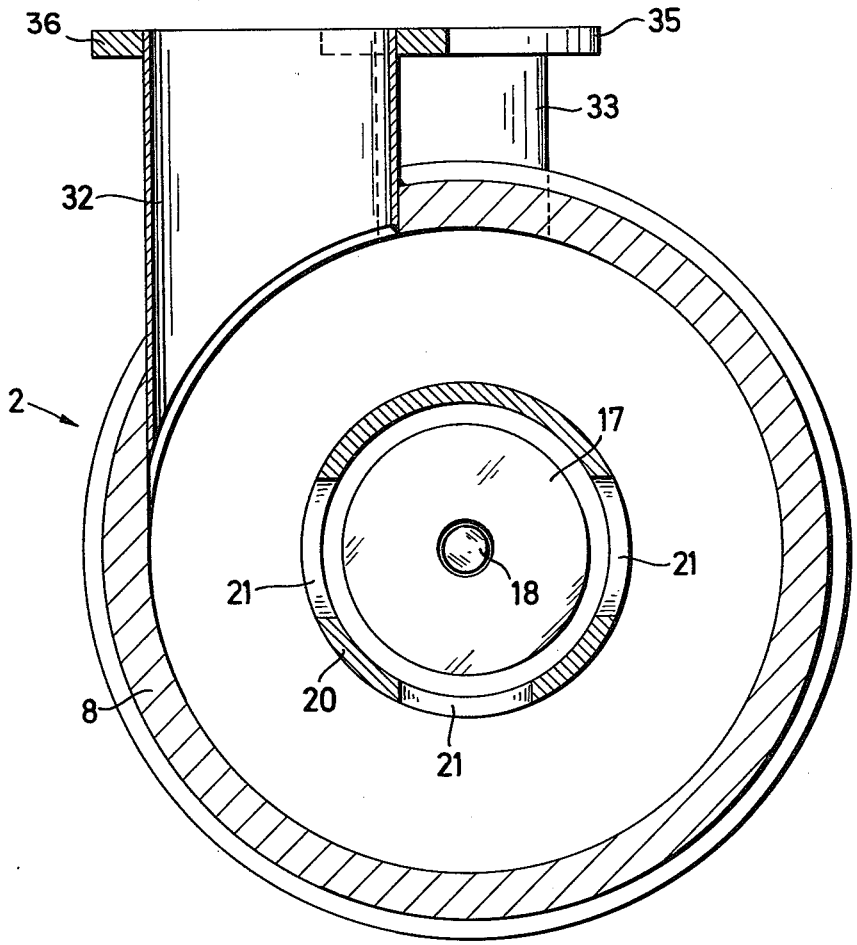
FIG. 2 is a cross-sectional view taken along the line II—II of FIG. 1.

The mixing and comminuting machine shown generally at 1 comprises an operating and tool part shown generally at 2 and a drive unit shown generally at 3. A motor, a portion of the housing which is shown at 4, drives a shaft 5 which projects into the operating and tool part 2 of the mixing and comminuting machine. The casing of the drive unit 3 includes a flange 6 and the open end of the drive unit 3 is closed by a plate 7 butting the flange.

The operating and tool part 2 of the mixing and comminuting machine 1 including a casing 8 which is preferably cylindrical and defines a chamber. In the chamber a casing inset is provided which consists of a cylindrical inset sleeve 9 and a backwall 10, the elements 9 and 10 being permanently connected to each other, e.g. by welding. A rotor 11 includes tool members consisting of crowns 12 and 13, the annular tool crown 12 having a plurality of individual teeth, projections or the like on its working surface. The tool crown 13 optionally may also have teeth, projections or the like. Stator member 14, mounted on inset sleeve 9, is also provided with an annular tool crown 15 confronting the tool crown 12 of the rotor member 11. The tool crown 15 may have individual projections, shoulders or the like on its working surface which extend coaxially relative to those on the tool crown 12. The working surface of the tool crown 12 has a generally truncated cone configuration while the confronting working surface of the tool crown 15 has a conical configuration.

The rotor and stator members 11, 14 along with the casing inset sleeve 9 and backwall 10 form an assembly or single structural unit. The motor member 11 is retained in position in the assembly between the backwall 10 and the stator member 14. The rotor member 11 is releasably secured to rotary shaft 5 between a spacer ring 16 and a plate 17, the plate 17 being secured by means of a screw 18 inserted in the end of the shaft 5. The rotor member 11 is clamped between the plate 17 and the ring 16 but may be readily released simply by removing the screw 18 so that the entire assembly can be withdrawn from the chamber of the casing 8.

The chamber of the casing 8 of the mixing and comminuting machine is closed by a cover 19. A spacer bushing 20 is welded to the interior surface of the cover 19 so that in closed position the end of the spacer bushing 20 presses against the stator member 14. The spacer bushing 20 is provided with ports 21 permitting the media to pass therethrough towards the rotor and stator members 11, 14. The cover 19 is a circular plate arranged to be inserted into the end of the chamber of the casing 8 and includes radially extended ribs 22 for reinforcement.

To clamp and secure the cover, opposite ends of a clamping yoke 23 engage behind shoulders or bolts 24 and 25, disposed on arms 26 and 27 extending from the end of the casing 8. A screw bolt 28 passing through the yoke 23 serves to apply pressure to a pressure plate 29 to retain the cover 19 in position and, consequently, by means of spacer bushing 20, retain also the assembly in position against the plate 7 which serves as an abutment means. The clamping yoke 23 may be utilized to remove the cover 19 and spacer bushing 20 by removing bolt 28, reversing the position of the yoke 23 against the bolts 24 and 25 as illustrated by dotted line 23*a*, inserting a puller screw 30 through the yoke 23 and into a threaded bore 31 of the cover 19. Rotation of puller screw 30 extracts the cover.

An inlet duct 32 is located tangentially on the cylindrical casing 8 which serves to admit the media to be treated into the chamber. To discharge the treated media, an outlet duct 33 extends radially from the cylindrical casing 8. The inlet and outlet ducts 32, 33 include flanges 35, 36 respectively for connecting to respective pipelines. Media fed into the chamber through inlet duct 32 pass through ports 21 into the interior of spacer bushing 20 and then pass radially between the working surfaces of the rotating tool crown 12 and the stationary tool crown 15, the treated media being discharged through outlet duct 33.

When the tool crowns become worn, the cover 19 and spacer bushing 20 are removed from the casing permitting the entire assembly as a single unit, including the rotor member 11 and stator member 14, to be removed from the chamber and replaced with a new assembly, after which the cover 19 and spacer bushing 20 are replaced to retain the new assembly in position in the chamber.

If the casing of the machine is eroded by the media, the casing 8 also may be easily replaced after removing the cover 19 with the spacer bushing 20 and the assembly, including the rotor member 11 and stator member 14. Casing 8 includes flange 8*a* which is retained in an annular recess of the plate 7 on the drive unit 3 and is secured in place by screws 34 passing through flange 6 of the drive unit. Upon removing the screws 34, the casing 8 may be removed and replaced with a new casing.

It will be appreciated that with the above described mixing and comminuting machine construction, considerable time and work is saved during assembly and disassembly resulting in substantial economic saving. The interchangeable parts are economically manufactured. The ease with which the constructional units may be interchanged does not in any way affect the safe operation of the machine.

Having thus set forth and disclosed the nature of this invention, what is claimed is:

1. A mixing and comminuting machine for the treatment of liquid-solid media and the like by compression and decompression under centrifugal action comprising:

a. a casing having a chamber;

b. rotary drive means at one end of said chamber;

c. an inlet and an outlet in said casing for passing said media through said casing;

d. a replaceable assembly releasably retained in said chamber, said assembly comprising a casing inset, a stator member having a first working surface and being stationarily mounted in said casing inset and a rotor member having a second working surface; and e. means for rotatably and releasably securing said rotor member to said rotary drive means at said one end of said chamber such that said first and second working surfaces are in spaced confronting relationship and said liquid-solid media may pass therebetween during rotation of said rotor member;

f. whereby when said securing means is released from said drive means, said assembly including said casing inset, rotor member and stator member may be readily replaced as a unit in said mixing and comminuting machine.

2. A machine according to claim 1 wherein said stator member has an annular configuration defining a port whereby said liquid-solid media may be directed through said port and radially between said first and second working surfaces.

3. A machine according to claim 1 wherein each of said stator and rotor members includes a tool crown providing said working surface, each said working surface including at least one projection thereon for treating said liquid-solid media as it passes between said respective tool crowns.

4. A machine according to claim 1 wherein said working surface of said rotor has a truncated cone configuration and said working surface of said stator has a corresponding conical configuration.

5. A machine according to claim 1 wherein said casing inset comprises an annular wall spaced from said stator member for retaining said rotor member in position between said stator member and said annular wall with said working surfaces of said stator and rotor members adjacent each other.

6. A machine according to claim 5 wherein said chamber in said casing is cylindrical and said casing inset is cylindrical.

7. A machine according to claim 1 further comprising abutment means at said one end of said chamber, said assembly being retained in said chamber adjacent said abutment means, a removable cover closing the end of said chamber opposite said abutment means and a spacer bushing extending between said cover and said assembly to retain said assembly between said spacer bushing and said abutment means when said cover is in place.

8. A machine according to claim 7 wherein said spacer bushing is a hollow tubular spacer with its opposite ends confronting said cover and assembly respectively and includes at least one perforation therein intermediate its ends to permit flow of said media from said inlet into the interior of said cylindrical spacer and toward said stator and rotor members.

9. A machine according to claim 7 further comprising means for clamping said cover in position such that said cover presses said spacer bushing against said assembly.

10. A machine according to claim 8 wherein said clamping means comprises a yoke extending between opposite sides of said casing and screw means extending between said yoke and said cover to press said cover and spacer member against said assembly.

11. A machine according to claim 10 wherein said casing is cylindrical and said casing, securing and retaining means, cover, spacer bushing, rotor member and stator member are axially symmetric.

12. A machine according to claim 1 further comprising a motor housing and means releasably securing said casing to said motor housing, said casing and replaceable assembly constituting a replaceable unit releasably secured to said motor housing.

13. A machine according to claim 1 wherein said inlet comprises an inlet duct extending tangentially from said casing and said outlet comprises an outlet duct extending radially from said casing.

14. A replaceable assembly adapted to be releasably secured in the casing of a mixing and comminuting machine for the treatment of liquid-solid media and the like, said assembly comprising:

a. a casing inset, b. a stator member having a first working surface and being stationarily mounted in said casing inset and c. a rotor member having a second working surface;

d. said casing inset retaining said rotor member within said casing inset adjacent said stator member whereby said assembly including said casing inset, rotor member and stator member may be readily replaced as a unit in said mixing and comminuting machine.

15. An assembly according to claim 14 wherein said stator member has an annular configuration defining a port whereby said liquid-solid media may be directed through said port and radially between said first and second working surfaces.

16. An assembly according to claim 14 wherein said working surface of said rotor has a trucated cone configuration and said working surface of said stator has a corresponding conical configuration.

17. An assembly according to claim 14 wherein each of said stator and rotor members includes a tool crown providing said working surface and has projections thereon for treating said liquid-solid media as it passes between said tool crowns.

18. An assembly according to claim 14 wherein said casing inset comprises an annular wall spaced from said stator member for retaining said rotor member between said stator member and said annular wall with said working surfaces confronting each other.

19. An assembly according to claim 14 wherein said working surface of said rotor has a trucated cone configuration and said working surface of said stator has a corresponding conical configuration.

* * * * *